US010773848B2

(12) United States Patent
Heller

(10) Patent No.: US 10,773,848 B2
(45) Date of Patent: Sep. 15, 2020

(54) METHOD OF OPERATING A PACKAGING MACHINE

(71) Applicant: Bizerba SE & Co. KG, Balingen (DE)

(72) Inventor: Franz Heller, Herrenberg (DE)

(73) Assignee: BIZERBA SE & CO. KG, Balingen (DE)

( * ) Notice: Subject to any disclaimer, the term of this patent is extended or adjusted under 35 U.S.C. 154(b) by 703 days.

(21) Appl. No.: 15/390,199

(22) Filed: Dec. 23, 2016

(65) Prior Publication Data

US 2017/0190453 A1 Jul. 6, 2017

(30) Foreign Application Priority Data

Dec. 30, 2015 (EP) ..... 15203189

(51) Int. Cl.
*B65B 59/02* (2006.01)
*B65B 11/54* (2006.01)
(Continued)

(52) U.S. Cl.
CPC ..... *B65B 59/02* (2013.01); *B65B 11/48* (2013.01); *B65B 11/54* (2013.01); *B65B 35/10* (2013.01);
(Continued)

(58) Field of Classification Search
CPC ..... B65B 41/14; B65B 11/08; B65B 59/02; B65B 11/48; B65B 11/54; B65B 35/10;
(Continued)

(56) References Cited

U.S. PATENT DOCUMENTS 4,035,985 A * 7/1977 Aoyama ..... B65B 11/54 53/453
4,078,363 A * 3/1978 Ranzi ..... B65B 11/54 53/228
(Continued)

FOREIGN PATENT DOCUMENTS

CA 2303211 A1 * 1/2000 ..... B65B 59/00
DE 102008032019 A1 1/2010
(Continued)

OTHER PUBLICATIONS

Machine translation of Sakata (JP 2005119711 A) (Year: 2005).*
(Continued)

*Primary Examiner* — Chelsea E Stinson
*Assistant Examiner* — Himchan Song
(74) *Attorney, Agent, or Firm* — Kilpatrick Townsend & Stockton LLP

(57) ABSTRACT

The invention relates to a method of operating a packaging machine for wrapping packaging trays for foods using a packaging film, in particular a plastic film, in which the film is supplied to a holding mechanism having two holding means spaced apart from one another to hold the supplied film at two mutually oppositely disposed sides; in which the spacing of the two holding means from one another is then adjusted: and in which a supplied tray is subsequently pressed toward the supplied film by lifting from below, wherein the holding mechanism is adjusted such that the spacing of the two holding means from one another is reduced.

7 Claims, 1 Drawing Sheet

(51) Int. Cl.

| | |
|---|---|
| ***B65B 11/48*** | (2006.01) |
| ***B65B 35/10*** | (2006.01) |
| ***B65B 41/12*** | (2006.01) |
| ***B65B 45/00*** | (2006.01) |
| ***B65B 57/12*** | (2006.01) |

(52) U.S. Cl.
CPC ..... *B65B 41/12* (2013.01); *B65B 45/00* (2013.01); *B65B 57/12* (2013.01)

(58) Field of Classification Search
CPC .. B65B 41/12; B65B 59/001; B65B 2011/002
USPC ..... 53/389.1, 389.2, 228–230, 493, 504, 64, 53/66, 441, 446, 556
See application file for complete search history.

(56) References Cited

U.S. PATENT DOCUMENTS

| | | | | | |
|---|---|---|---|---|---|
| 4,388,796 | A * | 6/1983 | Zelnick | B65B 11/54 | 53/218 |
| 4,501,106 | A * | 2/1985 | Treiber | B65B 11/54 | 53/66 |
| 4,520,613 | A * | 6/1985 | Claudio | B65B 11/54 | 198/626.5 |
| 5,144,787 | A * | 9/1992 | Whitby | B65B 11/54 | 53/222 |
| 5,205,104 | A * | 4/1993 | Nakashima | B65B 11/54 | 53/389.2 |
| 5,473,861 | A * | 12/1995 | Fukunaga | B65B 11/54 | 53/228 |
| 5,855,106 | A | 1/1999 | Koyama et al. | | |
| 6,189,302 | B1 * | 2/2001 | Kudo | B65B 11/54 | 294/902 |
| 2001/0027632 | A1 * | 10/2001 | Whitby | B65B 35/24 | 53/389.2 |
| 2002/0166858 | A1 * | 11/2002 | Ogishima | B65D 77/2012 | 220/359.4 |
| 2008/0236108 | A1 * | 10/2008 | Parmley | B65B 57/12 | 53/504 |
| 2016/0229574 | A1 * | 8/2016 | Tanaka | B65B 57/10 | |

FOREIGN PATENT DOCUMENTS

| | | | | | |
|---|---|---|---|---|---|
| DE | 102009041470 | A1 | | 3/2011 | |
| EP | 0340157 | A1 | * | 11/1989 | B65B 11/54 |
| EP | 0340157 | A1 | | 11/1989 | |
| EP | 0569615 | A1 | | 11/1993 | |
| EP | 0648674 | A1 | | 4/1995 | |
| EP | 0687558 | A2 | | 12/1995 | |
| EP | 1036738 | A1 | | 9/2000 | |
| EP | 3093244 | A1 | | 11/2016 | |
| EP | 3098172 | A1 | | 11/2016 | |
| GB | 1362146 | A | * | 7/1974 | B65B 47/10 |
| JP | H1059311 | A | * | 3/1998 | |
| JP | H1191708 | A | * | 4/1999 | |
| JP | 2005119711 | A | * | 5/2005 | B65B 59/00 |

OTHER PUBLICATIONS

European Patent Office, European Search Report received in European Patent Application No. 15203189.4-1708, dated Jun. 13, 2016, 2 pages.

European Patent Office, *Notice of Opposition in a European Patent* dated Mar. 12, 2020 received in European patent application No. 15203189.4, 20 pages.

* cited by examiner

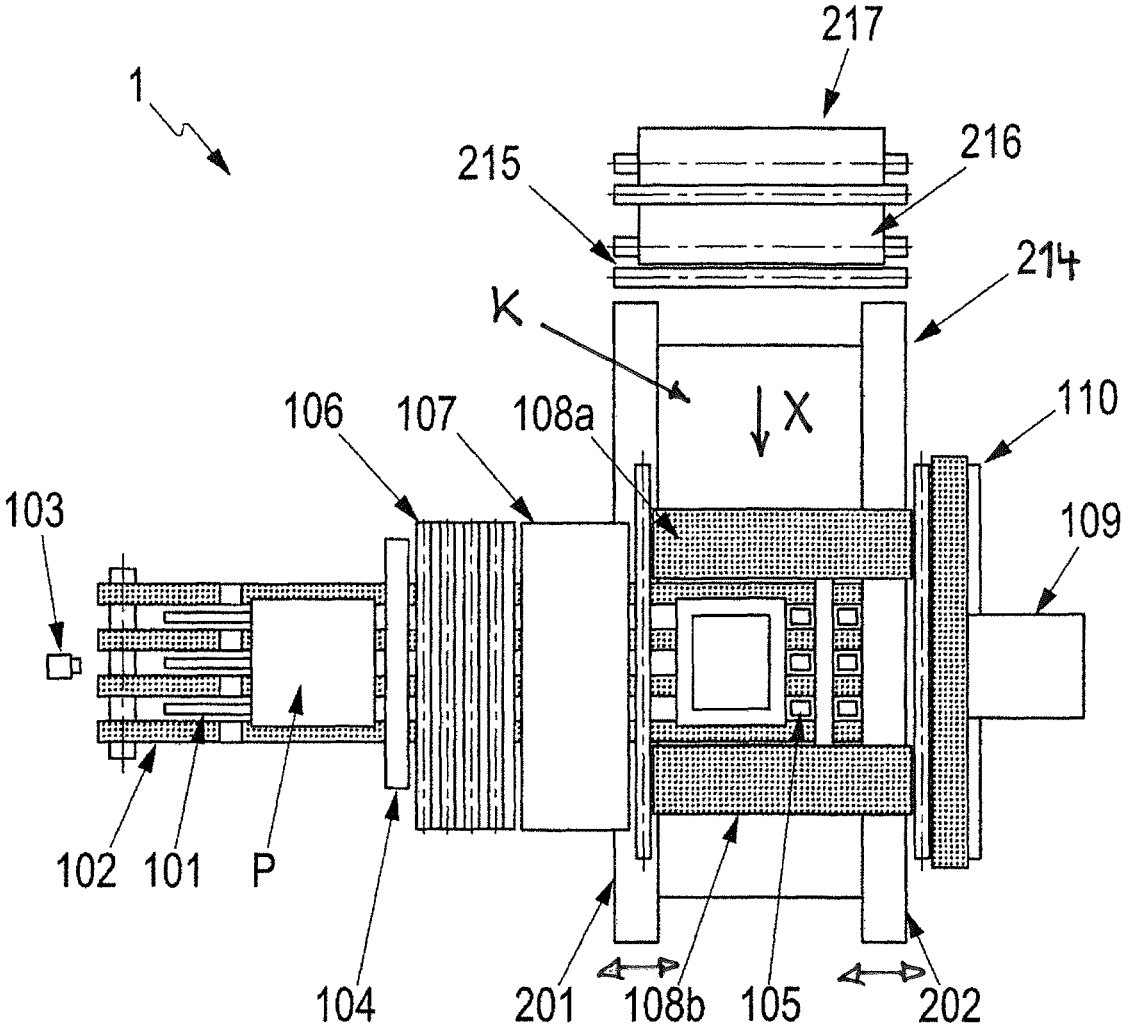
1
217
216
215
214
K
X
110
106
107
108a
103
109
102
101
P
104
201
108b
105
202
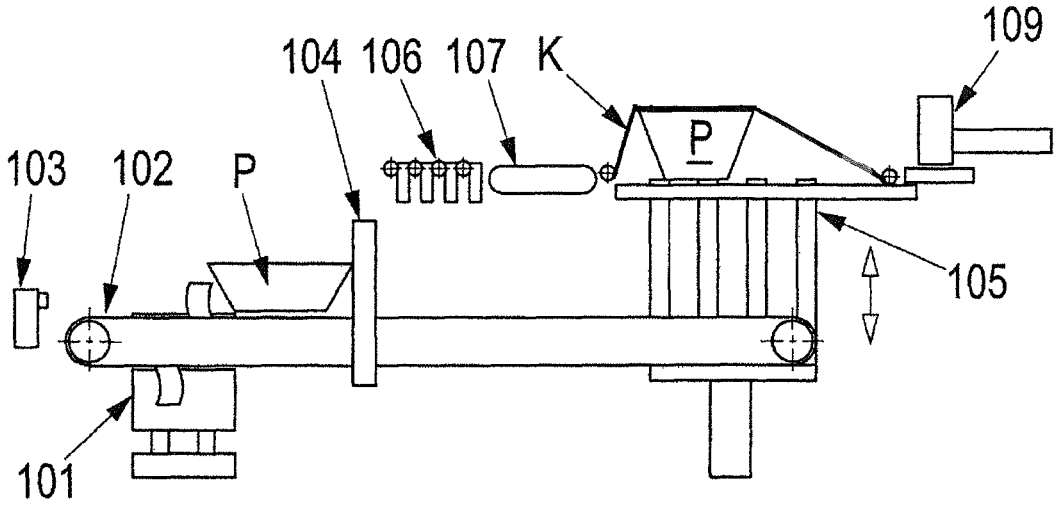
109
104
106
107
K
P
103
102
P
105
101

METHOD OF OPERATING A PACKAGING MACHINE

The present invention relates to a method of operating a packaging machine for wrapping packaging trays for foods using a packaging film, in particular a plastic film, in which the film is supplied to a holding mechanism having two holding means spaced apart from one another to hold the supplied film at two mutually oppositely disposed sides, in which the spacing of the two holding means from one another is then adjusted, and in which a supplied tray is subsequently pressed toward the supplied film by lifting from below. The present invention furthermore relates to a corresponding packaging machine.

Packaging trays are known from supermarkets in which food products are packed, with the food product and the tray being wrapped around by a stretch film. Packaging trays for food products are generally also simply called trays. A packaging machine is used for the packaging that comprises a supply device for supplying the film, a holding mechanism for holding the supplied film at two mutually oppositely disposed sides, and a supply belt by which the trays having the food products are supplied to a lifting device, in particular to a lifting table. The lifting device then lifts the supplied tray toward the stretch film so that the film is spanned over the tray. The stretch film is pretensioned in this process, i.e. the spacing of the two holding means is increased after the supply of the stretch film and before the tray having the food product is lifted toward the film. It is hereby achieved that the film can lie uniformly and cleanly at the tray having the food product. The film is subsequently led around the tray by means of lateral folding tongs and by means of a rear folding tong and is folded beneath the tray base. The front film end is also folded beneath the tray base on departing the lifting device. The film is then welded beneath the tray, e.g. by means of a hotplate over which the tray is guided. The tray having the food is then completely enclosed by a tensioned film.

Such a packaging machine is known, for example, from U.S. Pat. No. 5,855,106. A stretch film that can be processed by such a packaging machine is known from EP 0 687 558 A2, for example.

Such packaging machines are used for the packaging of solid, flat foam trays in which e.g. meat is packaged. Such packaging machines are, however, not suitable for high packaging trays such as are used for packaging salad since such packaging trays are as a rule very unstable and their side walls would kink inward on being lifted or pressed toward the pretensioned film, whereby the food located therein would be compressed. Other packaging machines are therefore used for high, unstable packaging trays in which the packaging tray is supplied to a film tube which surrounds the packaging tray. After cutting the tube, the tube ends are led beneath the packaging tray and are welded there.

It is the underlying object of the invention to provide a method and a packaging machine of the initially named kind that allow packaging trays having high, unstable side walls also to be processed without such packaging trays being crushed during packaging.

This object is satisfied by a method having the features of claim 1 and in particular in that the holding mechanism is adjusted such that the spacing of the two holding means from one another is reduced. In accordance with the invention, the film is therefore supplied to the holding mechanism at a first spacing of the two holding means from one another and the holding mechanism is adjusted such that the spacing of the two holding means from one another is reduced from the first value to a second value. The reduction of the spacing of the two holding means from one another has the effect that the supplied film sags between the two holding means.

Unlike as known in the prior art, the film is therefore not pretensioned, but in contrast the focus is rather on a sagging of the film. It can hereby be achieved that packaging trays having high, unstable side walls are not destroyed when the packaging trays are pressed toward the film from below. It is made possible by the invention that the packaging machines known from the prior art that were to date only suitable for the packaging of solid, flat packaging trays can also be used by a correspondingly slight modification for packaging trays having high unstable side margins. A single universal packaging machine can thus take over both the packaging of solid, flat packaging trays and the packaging of packaging trays having high unstable side walls.

Provision can be made in accordance with an embodiment that the amount of the reduction of the spacing of the two holding means from one another, in particular the fixing of the aforesaid second value, takes place in dependence on the tray type and/or on at least one dimension of the supplied tray. The amount of the reduction can accordingly be adapted to the respective supplied packaging tray. Provision can in particular be made that the spacing is reduced the more, the larger the height and/or the base surface (or the footprint) of the supplied tray. With trays having especially high side walls, the film then sags more than with trays having side walls that are lower in comparison therewith.

It is generally possible that the tray type and/or the height and/or the base surface of the supplied tray is and/or are input into an input unit of the packaging machine and that the amount of the reduction of the spacing or the aforesaid second value is determined with reference to the input. Provision can, however, alternatively or additionally, also be made that the tray type of the supplied tray is automatically recognized and/or at least one dimension of the supplied tray is automatically determined. The recognition of the tray type can take place by means of an object recognition device, for example a camera; the determination of the at least one dimension, for example, by means of a camera or of a light barrier.

Finally, the film encompassing the tray can be folded laterally and at a rear end beneath the tray; the tray can be transferred with the film folded beneath the tray to a hotplate, whereby a front end of the film is folded beneath the tray; and the film ends are welded to the lower side of the tray by means of the hotplate. The packaging tray with the food located therein is thus completely enveloped by the film.

The invention furthermore relates to a packaging machine for wrapping packaging trays for foods using a packaging film, in particular a plastic film, in particular for carrying out the method in accordance with the above disclosure, having a supply device for supplying the film, having a holding mechanism comprising two holding means spaced apart from one another to hold the supplied film at two mutually oppositely disposed sides, with the spacing of the two holding means from one another being adjustable, having a supply belt for supplying the trays and having a lifting device to press the supplied tray toward the supplied film by lifting from below, with the packaging machine comprising an operating mode in which the spacing of the two holding means from one another is reduced with a supplied film and before the supplied tray is pressed toward the supplied film by lifting from below. A monitoring unit for controlling the packaging machine can in particular be provided that is configured to reduce the spacing of the two holding means from one another with a supplied film. The same advantages result in this respect such as have been described above with respect to the method in accordance with the invention. The packaging machine can in particular comprise a further operating mode in which the spacing of the two holding means from one another is increased with a supplied film and before the supplied tray is pressed toward the supplied film by lifting from below. The operation known from the prior art of the packaging machine is hereby additionally made possible, i.e. both an operation with a sagging film and an operation with a pretensioned film is possible.

Preferred embodiments of the packaging machine in accordance with the invention result in an analog manner from the further developments of the method in accordance with the invention. Advantageous embodiments of the invention are set forth in the dependent claims, in the description and in the drawing.

A non-restrictive embodiment of the invention is illustrated in the drawing and will be described in the following.

In this respect, the only FIGURE, FIG. 1, shows a schematic representation of a film packaging machine 1 in accordance with the invention. A schematic plan view is shown in the upper part of the FIGURE and a side view of the packaging machine 1 is shown in the lower part of the FIGURE.

The packaging machine 1 comprises a film dispensing device 217, a film supply device 216, a film transport device 214, and a film cutting device 215 arranged between the film supply device 216 and the film transport device 214. A roll of a packaging film K, in particular of a plastic film, can be placed into the film dispensing device 217 and can be held there by a film holder or roll holder. An unwound end of the film K can then be transferred to the film transport device 214 by means of the film supply device 216.

The film transport device 214 has two belt conveying devices 201 and 22 that are arranged spaced apart in parallel with one another to convey the supplied film K to two mutually oppositely disposed sides in a direction of transport X until the front edge of the film K has arrived at the end of the film transport device 214 at the front viewed in the direction of transport X, whereupon the film transport is stopped and the film K is cut off from the remaining film roll via the film cutting device 215.

The belt conveying devices 201 and 202 are furthermore configured to hold the film K, in particular the cut-off film, clampingly at the two mutually opposite sides. For this purpose, for example, lifting actuators, not shown, can be provided such as are generally known from the prior art.

The film transport device 214 is configured such that the spacing of the two belt conveying devices 201 and 202 from one another is adjustable. To adjust the mutual spacing, the first belt conveying device 201 or the second belt conveying device 202 or both belt conveyor devices 201 and 201 can be moved simultaneously transversely to the film transport direction X, in particular by means of a motor drive that is controlled by a monitoring unit of the packaging machine 1.

The packaging machine 1 furthermore has a supply belt 102 via which packaging trays P to be wrapped with the film K and having food products located therein can be supplied to a lifting table 105 of the packaging machine 1. The lifting table 105 is configured to transport a respective tray P upwardly to the film K held in the film transport device 214 such that the tray P is pressed toward the tray K from below such that the film K is automatically laid around the tray P during the lifting procedure.

To be able to use the packaging machine 1 for packaging trays P having high unstable side walls without crushing the weak packaging trays P during the pressing toward the film K, provision is made in accordance with the invention to reduce the mutual spacing of the two belt conveying devices 201 and 202 such that the film K that is spanned between the two belt conveying devices 201 and 202 sags at least slightly. Unlike as known from the prior art, the film K is therefore not pretensioned by increasing the spacing between the two belt conveying devices 201 and 202, but a sagging of the film K is rather intended. When the tray P is pressed toward the film K from below, a resistance exerted by the film K can therefore be minimized, with it not necessarily having to be precluded in this respect that the film K may be very slightly tensioned after the lifting of the tray P.

A camera 103 with which different tray types can be recognized is provided in the run-in region of the supply belt 102. On the basis of the recognized tray type, a determination can then be made as to how much the spacing of the two belt conveying devices 201 and 202 has to be reduced to achieve a sufficiently great sagging of the film K for the respective tray type. Such an association between the tray type and the spacing reduction can be stored in a memory of the packaging machine 1. Alternatively or additionally, a light barrier 104 can be provided to determine the height of the supplied trays P, with a conclusion likewise being able to be drawn on the amount of the required reduction of the spacing from the determined height. The spacing can in particular be reduced the more, the greater the height and/or the base surface of the supplied tray P is. The light barrier 104 can in another respect also additionally be used to trigger a start signal for the packaging process.

For the further wrapping of the packing trays P, the film K is led downwardly around the tray P at the sides and at the rear by means of lateral folding tongs 108*a* and 108*b* as well as by a rear folding tong 110 after the lifting of the packaging tray P and is folded beneath the tray P or beneath the base of the tray P. The tray P is subsequently pushed out of the film packaging zone by means of a pusher 109 onto a sealing plate 107, whereby the front end of the film K is also folded beneath the tray P. The sealing plate 107 is heated to a temperature at which the ends of the film K folded beneath the tray P are welded to one another and/or sealed.

The packaged tray P can subsequently be transported via a transverse conveyor belt 106 to a labeling apparatus, not shown in the FIGURE, and can be provided with a label. A scale 101 is arranged beneath the supply belt 102 for this purpose and the weight of the supplied packaging trays P having the food products can be determined by it. A printer connected to the scale 101 can then print a label on which the weight of the filled tray P is indicated. The labeling apparatus takes over the label from the printer and applies it to the packaged tray P.

A plastic film that is stretchable, i.e. a so-called stretch film, can be used as the packaging film. This film is thermoplastic and can be sealed or welded at a high temperature. The thickness of the film is typically in a range between 10 μm and 60 μm.

REFERENCE NUMERAL LIST

1 packaging machine
101 scale
102 supply belt
103 camera
104 light barrier
105 lifting table
106 transverse conveyor belt

107 sealing plate
108*a* lateral folding tong
108*b* lateral folding tong
109 pusher
110 rear folding tong
201 belt conveying device
202 belt conveying device
214 film transport device
215 film cutting device
216 film supply device
217 film dispensing device
K packaging film
P packaging tray (having the food product)
X direction of transport

The invention claimed is:

1. A method of operating a packaging machine for wrapping packaging trays for foods using a packaging film, the method comprising the steps of:

supplying the packaging film to a holding mechanism, wherein the holding mechanism comprises two holding means spaced apart from one another to hold the supplied packaging film at two mutually oppositely disposed sides, and wherein the packaging film is held between the two holding means at a first distance;

adjusting a spacing of the two holding means from the first distance to a second distance shorter than the first distance so that the packaging film held between the two holding means is caused to sag downwardly towards a packaging tray below the packaging film; and after the packaging film is caused to sag downwardly, lifting the packaging tray from below toward the sagging packaging film in order for the packaging tray to contact and press against the sagging packaging film.

2. The method in accordance with claim 1, wherein a degree of reduction of the spacing of the two holding means from one another is based on a packaging tray type and/or on at least one dimension of the supplied packaging tray.

3. The method in accordance with claim 1, wherein a degree of reduction of the spacing is based on a height and/or a base surface area of the supplied packaging tray.

4. The method in accordance with claim 1, further comprising a step of automatically recognizing a packaging tray type of the supplied packaging tray.

5. The method in accordance with claim 4, wherein the step of automatically recognizing the packaging tray type of the supplied packaging tray is carried out by means of one of a camera and a light barrier.

6. The method in accordance with claim 1, further comprising a step of automatically determining at least one dimension of the supplied packaging tray.

7. The method in accordance with claim 6, wherein the step of automatically determining at least one dimension of the supplied packaging tray is carried out by means of one of a camera and a light barrier.

* * * * *